US007857908B2

(12) United States Patent
Lee

(10) Patent No.: US 7,857,908 B2
(45) Date of Patent: Dec. 28, 2010

(54) DISHWASHER AND CONTROLLING METHOD THEREOF

(75) Inventor: Jhe Hyouk Lee, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 939 days.

(21) Appl. No.: 11/432,323

(22) Filed: May 12, 2006

(65) Prior Publication Data

US 2006/0260649 A1 Nov. 23, 2006

(30) Foreign Application Priority Data

May 23, 2005 (KR) ..... 10-2005-0043107

(51) Int. Cl.
*B08B 7/04* (2006.01)
*B08B 3/02* (2006.01)

(52) U.S. Cl. ..... 134/18; 134/25.2; 134/56 D; 134/172; 134/173; 134/184

(58) Field of Classification Search ..... 134/25.2, 134/34, 56 R, 57 D, 56 D, 58 R, 58 D, 198, 134/199, 18, 17, 173, 184
See application file for complete search history.

(56) References Cited

U.S. PATENT DOCUMENTS

2006/0054198 A1* 3/2006 Choi ..... 134/56 D

* cited by examiner

*Primary Examiner*—Michael Barr
*Assistant Examiner*—Saeed T Chaudhry
(74) *Attorney, Agent, or Firm*—McKenna Long & Aldridge LLP

(57) ABSTRACT

A dishwasher is provided. The dishwasher has a wash motor for pumping wash liquid, upper and lower spray arm for spraying the wash liquid pumped by the wash motor, and a control unit. The control unit operates the wash motor to perform a lower wash cycle by the lower spray arm and an upper wash cycle by the upper spray arm. The control unit operates the wash motor at a preset first rpm and operates the wash motor at a second rpm for a predetermined duration during the upper wash cycle.

5 Claims, 6 Drawing Sheets

DISHWASHER AND CONTROLLING METHOD THEREOF

This application claims priority to Korean Application 10-2005-0043107 filed on May 23, 2005, which is incorporated by reference, as if fully set forth herein.

BACKGROUND OF THE INVENTION

1. Field of the Invention

The present invention relates to a dishwasher, and more particularly, to a dishwasher and a controlling method thereof capable of obviating blockage of spray holes in the spray arms of the dishwasher by impurities during a wash cycle.

2. Description of the Related Art

A dishwasher is an apparatus that sprays wash liquid at high pressure to wash impurities from dishes placed on its racks.

A dishwasher includes a tub forming a wash compartment, and a sump installed at the bottom of the tub for storing wash liquid. The door of the dishwasher has a detergent cup formed in its inner panel for filling with a predetermined amount of detergent.

The dishwasher also includes a wash pump installed inside the sump for pumping wash liquid to the spray arms. The wash liquid pumped to the spray arms is sprayed at high pressure from spray holes formed at the ends thereof.

The wash liquid sprayed under high pressure collides with the surfaces of dishes and causes food residue and other impurities on the dishes to be removed and fall to the floor of the tub.

Also, a lower spray arm that sprays wash liquid upward is provided above the sump, an upper spray arm is disposed roughly in the center of the tub, and a top spray arm IS formed at the ceiling of the tub to spray wash liquid downward.

FIG. 1 is a flowchart of a controlling method for a dishwasher according to the related art.

First, after dishes to be washed are placed in an upper and/or lower rack of the dishwasher, the door is closed and the power is switched on.

When power is applied to the dishwasher, wash liquid is sprayed through the spray arms and nozzle. The spray arms rotate to spray dishes, removing them of impurities.

Specifically, a user selects a desired wash course and inputs operating commands in step S10. Then, wash liquid enters the sump in step S11, and a wash motor for pumping wash liquid stored in the sump under high pressure is operated in step S12. Especially, the wash motor is operated at the same rpm for both an upper and a lower wash cycle of the dishwasher.

Wash liquid is sprayed from the spray arms in step S13, and a cycle for removing impurities from the stored dishes is implemented in step S14.

Some dishwashers according to the related art employ a filter installed at the lower end of the tub, in order to prevent large-sized impurities, such as watermelon seeds and corn kernels, that are washed from dishes from entering the spray arms.

However, although the filter can prevent clogging of the spray arms and nozzle, impurities that accumulate on the filter and are not discharged automatically, so that a user must take the trouble of manually removing them.

Also, the spray holes of the spray arms and nozzle may be designed to be larger in size than a certain size of impurities. Although this may prevent clogging of the spray holes, the water pressure of the sprayed wash liquid is weakened. To compensate, the capacity of the wash pump must be increased.

SUMMARY OF THE INVENTION

Accordingly, the present invention is directed to a dishwasher and a controlling method thereof that substantially obviate one or more problems due to limitations and disadvantages of the related art.

An object of the present invention is to provide a dishwasher and a controlling method thereof that obviate blockage of the spray holes of spray arms by impurities during a wash cycle.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a dishwasher including: a control unit for performing a washing of dishes according to a wash course inputted through a control panel; and a wash motor operated according to a control signal from the control unit, wherein the control unit operates the wash motor at a first rpm and intermittently operates the wash motor at a second rpm, when an upper wash cycle is performed in the wash course.

In another aspect of the present invention, there is provided a controlling method of a dishwasher including: a control panel for inputting a wash course; a control unit for performing a wash cycle according to the wash course inputted in the control panel; and a wash motor for imparting a predetermined force for spraying wash liquid from a lower spray arm or an upper spray arm, according to a controlling of the control unit, wherein the control unit sets an rpm of the wash motor according to a passage through which wash liquid is pumped by means of a pumping pressure from the wash motor.

In a further aspect of the present invention, there is provided a controlling method of a dishwasher including performing a wash course inputted in a control panel, and intermittently operating a wash motor at a second rpm that is greater than a first rpm at which the wash motor was operating, when an upper wash cycle is being performed.

In a still further aspect of the present invention, there is provided a controlling method of a dishwasher including: inputting of a wash course by a user; and operating the dishwasher according to the inputted wash course, and setting a speed of a wash motor differently according to whether an upper wash cycle or a lower wash cycle is performed.

As described, a dishwasher and a controlling method thereof intermittently control the speed of a wash motor, in order to obviate blockage of spray holes by impurities.

Also, the speed of the wash motor is set to vary for an upper wash cycle and a lower wash cycle, so that washing effectiveness increases and an overload on the wash motor is prevented.

Additionally, because the dishwasher and controlling method thereof according to the present invention prevents blockage of the spray holes, the washing performance of the dishwasher improves, so that a user's confidence in the product increases.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
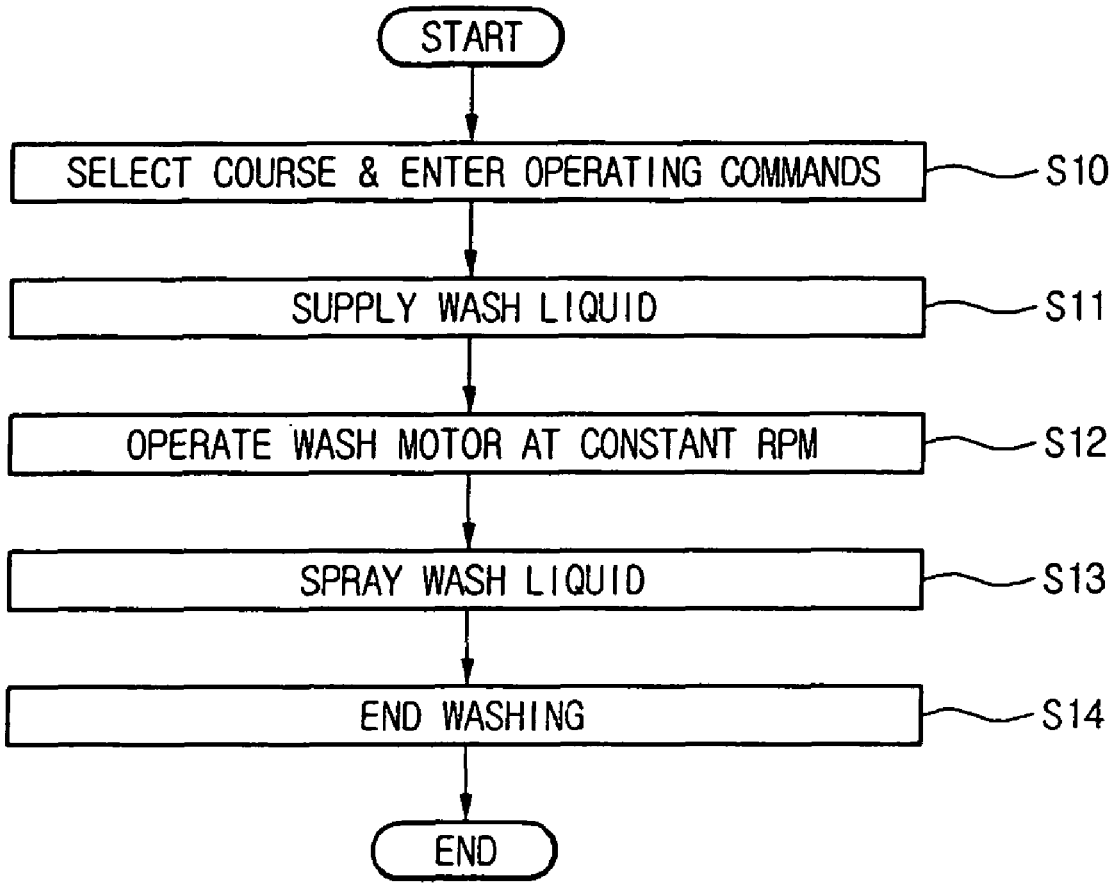
FIG.1 (related art)
FIG. 1 is a flowchart of a controlling method for a dishwasher according to the related art.
Figure 2:
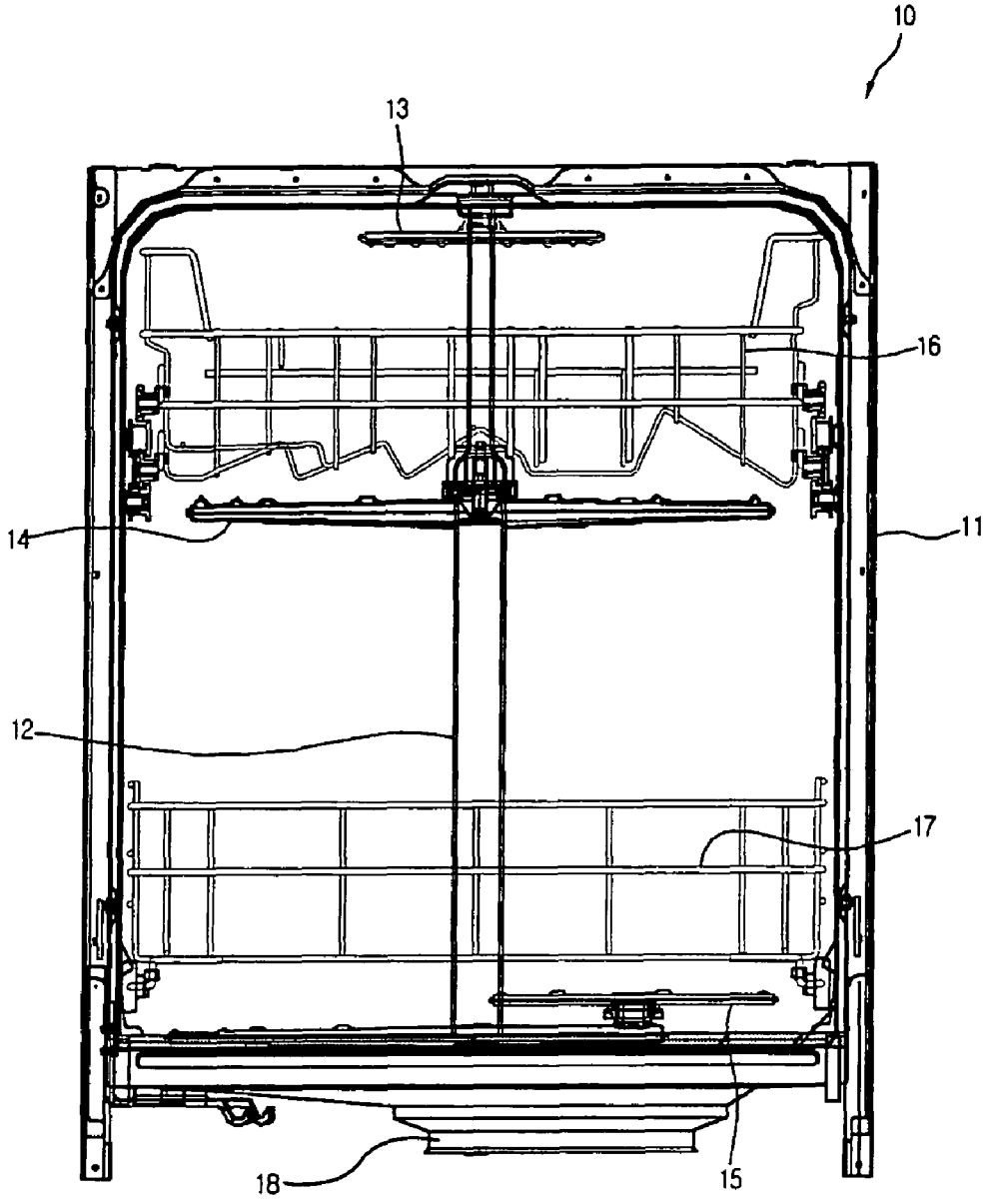
FIG. 2 is a schematic sectional view of a dishwasher according to an embodiment of the present invention.

FIG. 2 is a schematic sectional view of a dishwasher according to an embodiment of the present invention.

Referring to FIG. 2, a dishwasher 10 according to the present invention includes a tub 11 forming the outer shape of the dishwasher 10 and a wash compartment within, a sump 18 formed at the bottom portion of the tub 11 for storing wash liquid within, a wash pump (not shown) for spraying wash liquid stored in the sump 18 at high pressure, a water guide 12 forming a passage for the wash liquid to be sprayed by the wash pump, and an upper and top spray arm 14 and 13 (respectively branching out from predetermined regions of the water guide 12) and a lower spray arm 15 to spray wash liquid.

The spray arms 13, 14, and 15 each have a plurality of spray holes formed thereon for wash liquid to be sprayed through.

Further provided are an upper rack 16 and a lower rack 17 for storing dishes to be cleaned by the wash liquid sprayed from the spray arms 13, 14, and 15.

The wash liquid stored in the sump 18 is guided to the lower spray arm 15 or the water guide 12 by means of a vario valve (not shown), to perform a lower wash cycle by the lower spray arm 15 and an upper wash cycle by wash liquid flowing through the water guide 12.

In further detail, when the wash liquid is guide to the lower spray arm 15 by the vario valve, a lower wash cycle is performed. When the vario valve guides the wash liquid to the water guide 12, the upper spray arm 14 and the top spray arm 13 perform an upper wash cycle.

When the upper wash cycle is performed by the upper spray arm 14, the wash motor may be operated to intermittently raise its rpm. A description of the controlling of the wash motor's rpm will be given below with reference to the diagrams.

Figure 3:
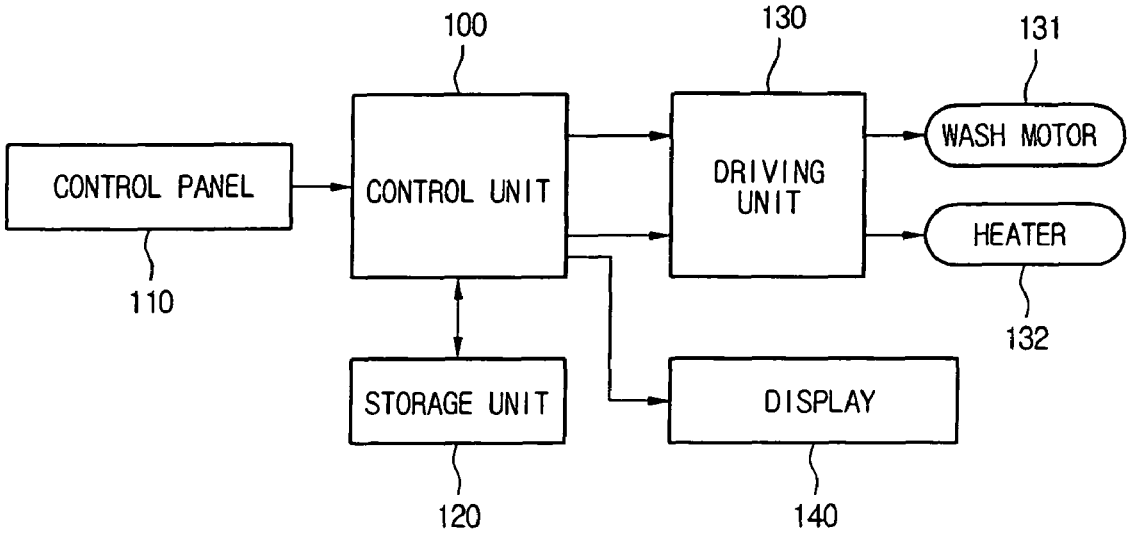
FIG. 3 is a block diagram describing a dishwasher according to an embodiment of the present invention.
Figure 4:
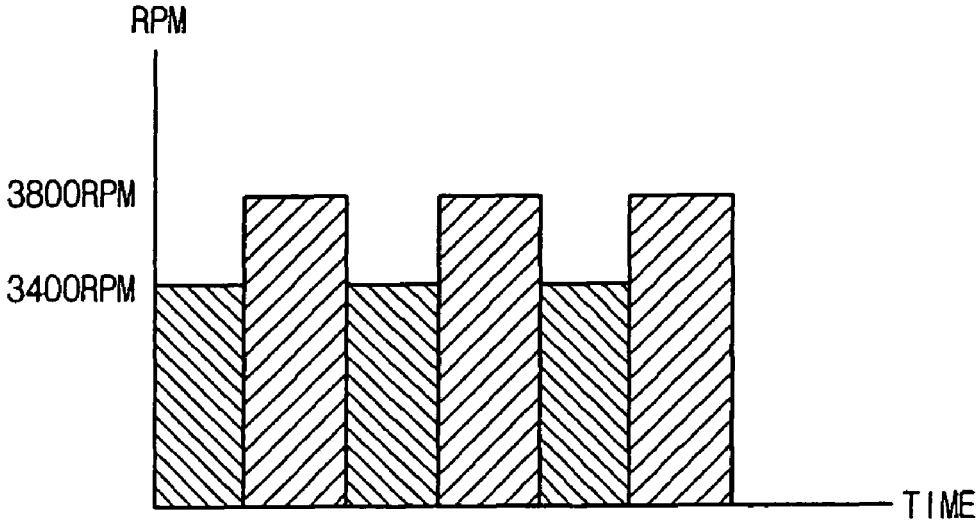
FIG. 4 is a graph showing exemplary rpm of a wash motor during the operation of an upper wash cycle.
Figure 5:
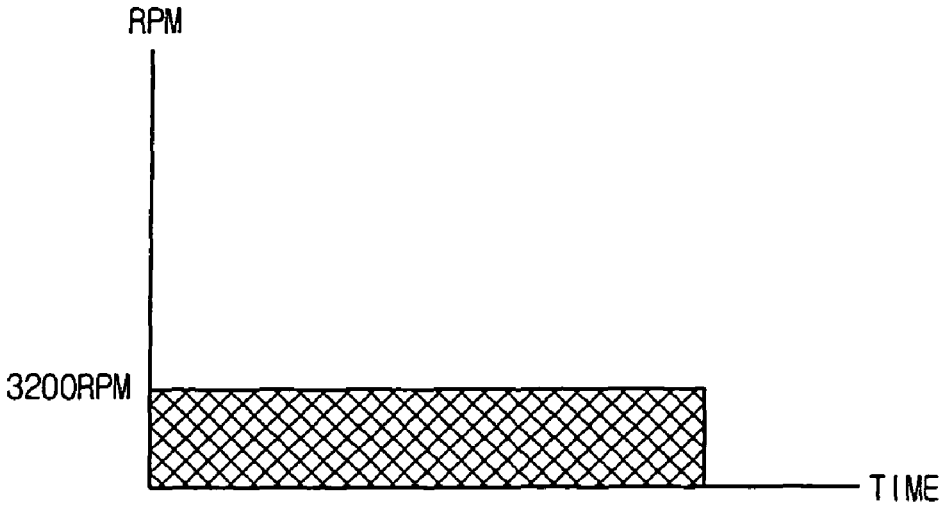
FIG. 5 is a graph showing exemplary rpm of a wash motor during the operation of a lower wash cycle.

FIG. 3 is a block diagram describing a dishwasher according to an embodiment of the present invention, FIG. 4 is a graph showing exemplary rpm of a wash motor during the operation of an upper wash cycle, and FIG. 5 is a graph showing exemplary rpm of a wash motor during the operation of a lower wash cycle.

Referring to FIGS. 3 through 5, a dishwasher according to the present invention includes a control panel 110 for inputting wash course settings, a control unit 100 for performing a wash course according to the settings inputted through the control panel 110, a driving unit 130 driven by control signals from the control unit 100, and a wash motor 131 and heater 132 that operate according to the driving of the driving unit 130.

Also included are a storage unit 120 for storing data for the time and speed (rpm) at which the wash motor 131 is to be operated, and a display 140 for displaying the operating status of the dishwasher.

Specifically, the control unit 100 controls the wash motor 131 at a predetermined rpm, according to the wash course selected through the control panel 110.

The control unit 100 also intermittently raises the rpm of the wash motor 131 in order to prevent blockage of the spray holes by impurities.

The speed of the wash motor 131 may be repeatedly raised and lowered over predetermined durations in a sporadic manner, or the wash motor 131 may be operated cyclically to raise its speed at regular intervals from a preset rpm.

For this purpose, the control unit 100 controls the speed of the wash motor 131 differently, based on whether the operating wash course is an upper or lower wash cycle.

In the case of an upper wash cycle, the control unit 100 operates the wash motor 131 at a first rpm of 3400 rpm and intermittently varies the speed to a second rpm of 3800 rpm, as shown in FIG. 4.

In the case of a lower wash cycle, the control unit 100 operates the wash motor 131 at a third rpm of 3200 rpm, as shown in FIG. 5. Here, the first through third rpms are preset values for the varying number of rotations per minute of the wash motor.

The control unit 100 does not need to reset the operating rpm of the wash motor 131 to an intermittently-varying setting for the lower wash cycle because the spray pressure of the lower spray arm is higher than that of the upper spray arm.

The storage unit 120 stores data for the operating duration and the speed of the wash motor 131 in a format that can be read by the control unit 100.

When the control unit 100 raises the speed of the wash motor 131 for a predetermined duration to prevent blockage of the spray holes, the control unit 100 may also display this operation on the display 140. A user can thus be notified of the intermittently increasing speed of the wash motor 131 through the display 140, so that the user's confidence in the dishwasher increases.

The heater 132 heats wash liquid stored in the sump to a high temperature, so that the wash liquid heated by the heater 132 can perform a hot wash cycle.

Figure 6:
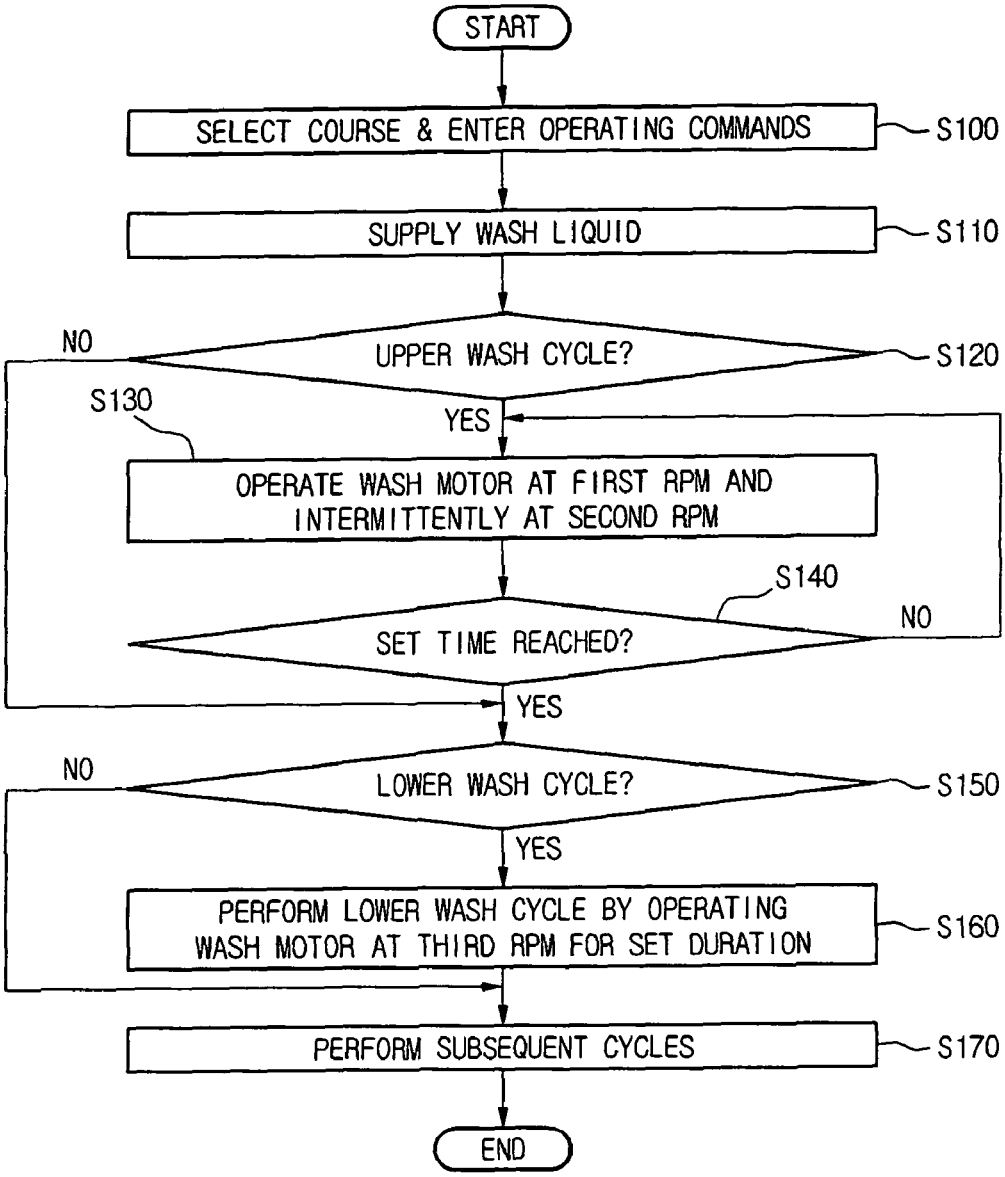
FIG. 6 is a flowchart of a controlling method of a dishwasher according to an embodiment of the present invention.

FIG. 6 is a flowchart of a controlling method of a dishwasher according to an embodiment of the present invention.

Referring to FIG. 6, a user first places dishes inside the dishwasher, selects a wash course using the control panel 110, and enters a start command in step S100.

Next, wash liquid (for washing the stored dishes) enters the sump in step S110, and the control unit 100 determines in step S120 whether the wash course inputted using the control panel 110 includes an upper wash cycle.

If the upper wash cycle is determined to be included, a passage for wash liquid from the sump to the water guide is formed by a vario valve, and the control unit 100 operates the wash motor 131 at the first rpm and intermittently raises the speed of the wash motor 131 to the second rpm in step S130.

In this way, the spray pressure of the wash liquid sprayed through the spray arms is intermittently increased, so that blockage of the spray holes formed on the spray arms can be obviated.

In step S140, it is determined whether the operation of the wash motor 131 in the upper wash cycle has reached a set time. In step S150, the control unit 100 determines whether a lower wash cycle was included in the inputted wash course.

The control unit 100 also determines if a lower wash cycle is included in the inputted wash course even when the results of step S120 show that an upper wash cycle was not included.

When the control unit 100 determines that a lower wash cycle was inputted, the control unit 100 operates the wash motor 131 for the third rpm over a set duration to implement the lower wash cycle in step S160.

When the operation of the wash motor 131 is completed with the end of the lower wash cycle, the next cycles of the wash course inputted through the control panel 110 are performed in step S170.

The dishwasher and the controlling method thereof according to the present invention described above prevent the blockage of spray holes by impurities during a wash cycle. Especially in an upper wash cycle, a wash motor operates intermittently from a preset first rpm to a higher second rpm, so that the spray pressure of wash liquid sprayed from an upper spray arm or a top spray arm is periodically increased.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dishwasher having a wash motor for pumping wash liquid and upper and lower spray arm for spraying the wash liquid pumped by the wash motor, the dishwasher comprising:

a control unit for operating the wash motor to perform a lower wash cycle by the lower spray arm and an upper wash cycle by the upper spray arm, the control unit is configured to operate the wash motor at a preset first RPM (round per minute) and operate the wash motor at a second RPM for a predetermined duration during the upper wash cycle, wherein the first RPM is less than the second RPM, and the speed of the wash motor is repeatedly raised and lowered in a sporadic manner, or the wash motor is operated cyclically to raise its speed at regular intervals from a preset rpm during the upper wash cycle, and the wash motor is operated at a lower RPM during the lower wash cycle than the first and the second RPM.

2. The dishwasher according to claim 1, wherein the operation of the wash motor at the second RPM by the control unit is repeated at predetermined intervals.

3. A dishwasher having a wash motor for pumping wash liquid and an upper and lower spray arm for spraying the wash liquid pumped by the wash motor, the dishwasher comprising:

a control panel for inputting a wash course; and a control unit for performing a wash cycle according to the wash course inputted in the control panel, the control unit is configured to operates the wash motor at a first RPM and intermittently at a second RPM that is higher than the first RPM during the operation at the first RPM, wherein the wash liquid is guided to a water guide forming a passage for the wash liquid to be sprayed by an upper spray arm, and the speed of the wash motor is repeatedly raised and lowered in a sporadic manner, or the wash motor is operated cyclically to raise its speed at regular intervals from a preset rpm if the wash liquid is sprayed by the upper spray arm, wherein the wash motor is operated at a lower RPM than the first and the second RPM if the wash liquid is sprayed by the lower spray arm.

4. A controlling method of a dishwasher comprising:

inputting a wash course including an upper wash cycle through a control panel;

drawing wash liquid into a sump;

performing the upper wash cycle by pumping the wash water stored in the sump to an upper spray arm and discharging the wash water into a tub, the wash water being pumped by a wash motor;

performing a lower wash cycle by pumping the wash water to a lower spray arm, the wash motor is configured to be operated at a lower RPM during the lower wash cycle than the RPM during the upper wash cycle; and changing a RPM (round per minute) of the wash motor during the upper wash cycle, the wash motor is configured to be operated at a preset first rpm and intermittently operated at a second rpm which is set at a greater value than the first RPM during the upper wash cycle, and the speed of the wash motor is repeatedly raised and lowered in a sporadic manner, or the wash motor is operated cyclically to raise its speed at regular intervals from a preset rpm during the upper wash cycle.

5. The controlling method according to claim 4, wherein intermittently operating the wash motor at the second RPM prevents a blockage of spray holes formed in the upper spray arm by impurities.

* * * * *